United States Patent [19]

Benford

[11] 3,975,851

[45] Aug. 24, 1976

[54] SLUG-STER SIGHT FOR A SHOTGUN

[76] Inventor: Jarrette Erwin Benford, P.O. Box 4707, Macon, Ga. 31208

[22] Filed: Nov. 4, 1974

[21] Appl. No.: 520,493

[52] U.S. Cl. ..... 42/1 S; 33/233; 33/252; 33/257

[51] Int. Cl.[2] ..... F41G 1/28; F41G 1/06

[58] Field of Search ..... 42/1 S; 33/233, 242, 33/252, 254, 257, 258, 261

[56] References Cited

UNITED STATES PATENTS

| | | | |
|---|---|---|---|
| 1,612,877 | 1/1927 | MacNaughton | 33/233 |
| 2,615,252 | 10/1952 | Wing | 33/242 |
| 2,795,048 | 6/1957 | Seymour et al. | 33/233 |
| 2,861,344 | 11/1958 | Moore | 33/233 |
| 3,840,995 | 10/1974 | Freiling | 42/1 S |

*Primary Examiner*—Charles T. Jordan
*Attorney, Agent, or Firm*—Marden S. Gordon

[57] ABSTRACT

A gun sight intended for detachable mounting on the rear of a barrel of a shotgun to provide an accurate aiming of the gun barrel with use of the front sight thereof to provide increased accuracy of the gun when used with a single shot slug rather than a conventional shotgun shell, the sight including a base adapted to frictionally mount the sight of the shotgun barrel, and a sight mounted on the base. A modified embodiment of the invention further includes a sight adjustably mounted on the base to provide adjustment for both windage and elevation, and an elevation bar movable relative to the sight and the base for adjusting the elevation of the sight.

9 Claims, 8 Drawing Figures

SLUG-STER SIGHT FOR A SHOTGUN

BACKGROUND OF THE INVENTION

1. Field of the Invention

This invention relates generally to shotgun accessories and more particularly to a novel rear mounted gun sight for detachable mounting on the rear portion of the barrel of the shotgun without requiring any modification to the barrel and in a manner providing an accurate gunsight for increased accuracy of aiming of the shotgun regardless of its choke or length, such as required when utilizing a special shotgun shell having a solid center slug rather than a conventional shotgun shell containing a multitude of shot elements.

2. Description of the Prior Art

The sport of hunting has been constantly on the increase, with one of the most popular weapons being that of a shotgun which utilizes conventional shotgun shells having a multitude of shot elements which fan out in a burst pattern when fired from the shotgun. When utilizing a shell of this conventional nature, such as in the hunting of fowl, due to the widespread burst pattern, there is no provision on the shotgun for the acccurate sighting and aiming of the shotgun as the hunter merely aims in the general direction of the prey with the widespread pattern effective to shoot the prey down.

As most hunters enjoy both fowl hunting as well as conventional bear and deer hunting, it has been necessary for the hunter to equip himself with a multitude of rifles in that a solid bullet as used in bear and deer hunting is not suitable for fowl hunting, and similarly, the widespread burst pattern of a conventional shotgun shell is not suitable for use in bear and deer hunting. This accordingly requires a large capital expenditure on the part of the hunter to equip himself with the necessary rifles, and due to such expense, many hunters have been able to only pursue one of the specific types of hunting.

In view of this problem of having to have several rifles for different types of hunting, the art has provided a special slug barrel for mounting on a shotgun to modify the shotgun to accept a solid bullet type shell, this special shell being referred to as a slug which has a solid center. However, a special slug barrel for a shotgun is quite expensive so that is has not met with widespread acceptance by hunters due to the expense thereof.

SUMMARY OF THE INVENTION

The present invention recognizes the popularity of the shotgun and the desirability of utilizing a shotgun barrel to fire a solid center slug for use in bear and deer hunting rather than fowl hunting, and accordingly provides a novel solution thereto in the form of a slipon sight adapted to be removably mounted to the rear portion of the barrel of a shotgun and intended for use with the normally provided front barrel sight in a manner providing a accurate aiming device for the shotgun regardless of its choke or length, this accurate aiming permitting the shotgun to be utilized with the special shotgun shell having a slug solid center for use in bear and deer hunting, with the sight being readily removable from the gun barrel with no modification thereto such that the shotgun can be used in the conventional manner with a conventional shotgun shell having a widespread burst pattern for use in the hunting of fowl.

It is a feature of the present invention to provide a slug-ster sight for a shotgun which is readily attached to and removed from the barrel of the shotgun in a manner requiring no modification of the barrel and permitting the shotgun to be used with conventional shells as well as with special slug solid center shells with accurate aiming therefore being provided.

A further feature of the present invention provides a slug-ster sight for a shotgun which is relatively simple in its construction and may be readily manufactured at a low cost and by simple manufacturing methods such that it can be retailed at a sufficiently low price to encourage widespread use thereof.

Still a further feature of the present invention provides a readily attachable and removable rear sight for a shotgun barrel which is possessed of few parts and which therefore is unlikely to get out of order.

Yet still a further feature of the present invention provides a slug-ster rear sight for a shotgun barrel which is easy to use and reliable and efficient in operation.

Still yet a further feature of the present invention provides a slug-ster rear sight for a shotgun barrel which is of a rugged and durable construction and which therefore may be guaranteed by the manufacturer to withstand many years of intended usage.

Yet still a further feature of the present invention provides a slug-ster rear sight for a shotgun which is adapted for mounting on the barrel of a wide variety of shotguns as manufactured by a variety of manufacturers.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENTS

Figures 1, 2, 3, 4, 5, 6, 7, 8:
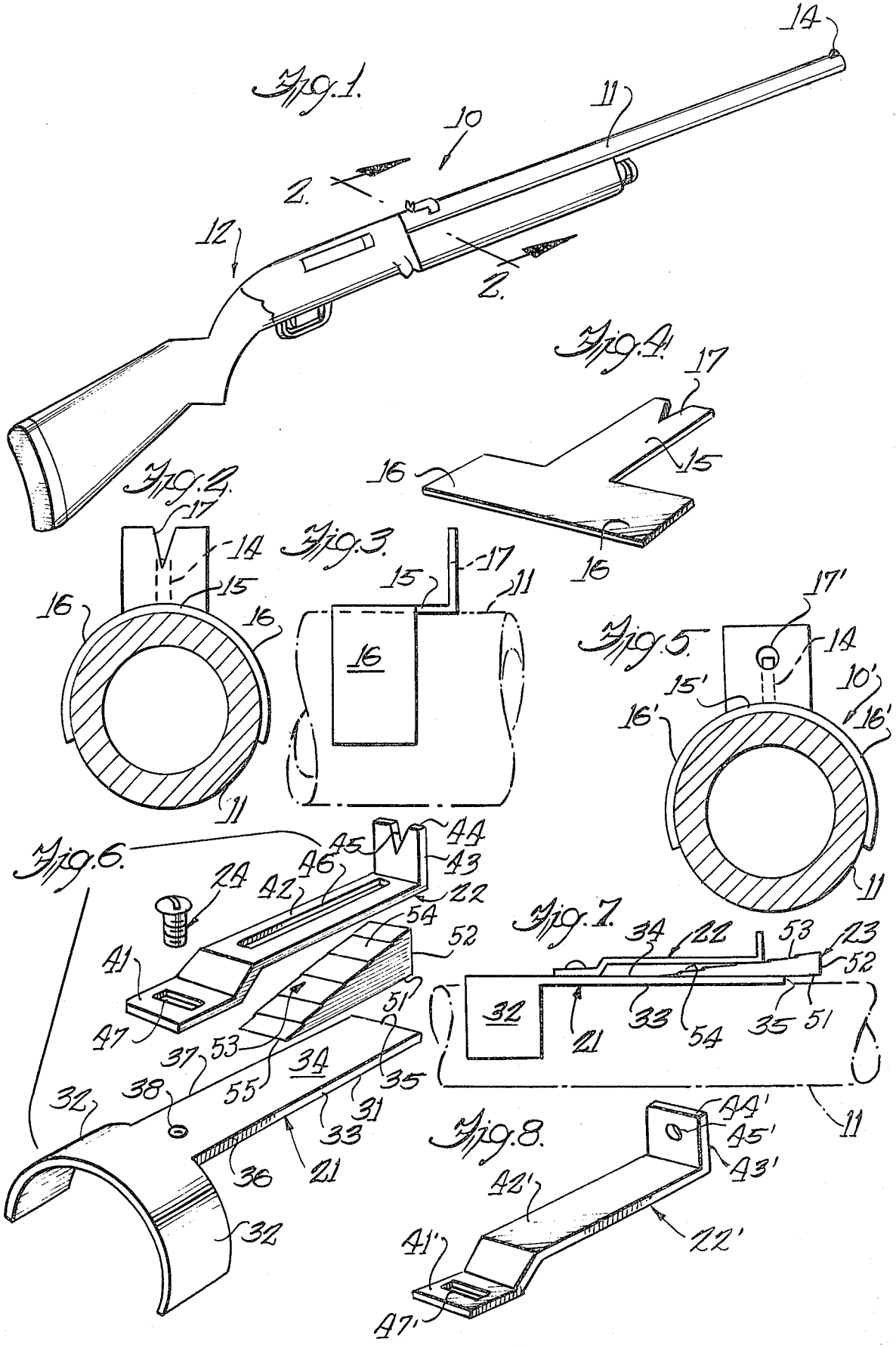
FIG. 1 is a perspective view of a shotgun having the rear sight of the present invention detachably mounted thereon.
FIG. 2 is an enlarged cross-sectional view taken along line 2—2 of FIG. 1.
FIG. 3 is a fragmentary side elevational view of the rear sight of FIG. 1.
FIG. 4 is a perspective view of the rear sight of FIG. 1 as stamped out of a blank of material prior to its being bent into the sight defining configuration.
FIG. 5 is a cross-sectional view similar to that of FIG. 2 and illustrating a modified form of the invention wherein the sight is of the peep type rather than of the open type as in FIG. 2.
FIG. 6 is an exploded perspective view of an alternative embodiment of the rear sight of the present invention.
FIG. 7 is a side elevational view of the sight as assembled on the shotgun barrel.
FIG. 8 is a perspective view of a modified form of the sight of FIG. 6 wherein the sight is of the peep type rather than the open type of FIG. 6.

Referring now to the drawings in detail and in particular to FIGS. 1 to 4 inclusive a first preferred form of a slug-ster rear sight for a shotgun constructed in accordance with the principles of the present invention is designated generally in its entirety by the reference numeral 10 and is illustrated as mounted on the rear portion of a barrel 11 of shotgun 12, the barrel having a conventional front sight 14 mounted thereon at the front end of the barrel.

The sight 10 may be manufactured out of metal, hard rubber, plastic, or any other suitable satisfactory material with the preferred embodiment being manufactured out of metal having a protective plastic or other type coating thereon to prevent its slipping on the barrel 11 as well as protecting the finish of the barrel 11 against any marring or scratching by the sight being attached thereto.

As seen in FIG. 4, the sight 10 is formed integrally of a single piece of material of a general T-shape having body member 15 terminating in one end in wing forming members 16 which project laterally outwardly of opposite side edges of the body member, the opposite end of the body member terminating in a V-shaped notch 17 disposed centrally thereof and opening out of the top edge thereof. As illustrated, the wings 16 are bent into an arcuate semi-circular configuration complementary to the diameter of a conventional shotgun barrel 11, with the notch portion 17 of body 15 being bent upward at a 90 degree angle to the top surface of the body member 15 to project diametrically opposite from the bending of wing 16 and with the apex of the notch placed upwardly from the plane of the body member 15.

The interior surfaces of the wing portion 16 may be coated with a plastic or other type coating on the wings thereof, also referred to as gripper legs, this preventing slipping and marring of the finish on the gun barrel 11 when the wings are slipped thereover to frictionally resiliently retain the sight 10 on the rear portion of the gun barrel with the notch 17 in longitudinal alignment with the front sight 14 so as to be viewed therethrough in conventional gun-sighting manner, this being generally as illustrated in FIG. 2.

Referring to the modified embodiment of FIG. 5, there is illustrated a gun sight 10' which is identical to the previously described gun sight 10 in all manners, except that instead of the V-shaped notch 17 there is provided a circular opening 17' which defines a peep sight and which is disposed in longitudinal alignment with front sight 14 when the device 10' is applied to the gun barrel 11 in the same manner as afore described for sight 10. Due to the similarity between parts of the two forms of the invention as disclosed in FIG. 5 and in FIGS. 1–4, and in order to avoid needless repetition of description and illustrative matter, similar reference numerals, but having a single prime mark applied thereto have been utilized to identify corresponding parts as between the two disclosures.

Referring now to the alternative embodiment of the invention as illustrated in FIGS. 6 and 7 inclusively, there is seen a base 21, a sight member 22, an elevation bar 23, and an adjusting screw 24.

The base 21 is formed of a single piece of material of a general T-shape having body portion 31 terminating at one end in laterally outwardly extending gripper leg portions 32 which are bent into a semi-circular configuration downwardly relative to the bottom surface 33 of the body portion. The body portion includes a flat top surface 34, a leading edge 35, opposed side edges 36 and 37, and an internally threaded aperture 38 disposed at the end of the body portion adjacentmost the legs 32. The angle of curvature of legs 32 is complementary to the diameter of a gun barrel 11, with the legs being of a resilient nature for the resilient gripping gun barrel therebetween with the bottom surface 33 of the base portion 31 resting thereon in longitudinal alignment with the front sight 14 of the gun barrel.

The sight member 22 is formed of an integral elongated rectangularly shaped member bent at selected portions therealong to provide a mounting platform 41 adapted to lie in parallel juxtaposition engaging base top surface 34, a main elongated body portion 42 and upwardly at its end joining with platform 41 so as to be spaced vertically from the top surface 34 of base 21 and to extend substantially parallel therealong and terminating in its opposite end in sighting portion 43 which is bent upwardly relative thereto at a ninety degree angle thereto and which terminates in top edge 44 having V-shaped sighting notch 45 formed therein. An elongated slot 46 extends longitudinally through body portion 42. A laterally extending slot 47 extends through platform 41 and is of a width at least equal to the diameter of threaded aperture 38 in base 21 for overlying the same when the sight member 22 is mounted thereon.

Screw 24 is adapted to pass through slot 47 and be threadedly received in threaded aperture 38 for retaining sight member 22 to base member 21, the sight member being adjustable by being moved along the axis of slot 47 relative to the axis of aperture 38 for adjustage of windage, this adjusting the line of vision obtained between notch 45 and front sight 14 when in use on shotgun 12.

The elevation bar 23 is of a triangular configuration having a flat base 51, a vertical end wall surface 52, and an angular top surface 53 formed of step like members 54 disposed in contiguous adjacent relationship and extending from a maximum height at back end wall surface 52 to a minimum height at its front terminal end 55. The elevation bar 23 is used to adjust the elevation of the sight 43 relative to the base 34, this being accomplished by sliding the wedge shaped elevation bar on base top surface 34 such that varying depths 54 of the elevation bar top surface 53 are brought into engagement with the bottom edge of sight member 22, the resiliency of the sight being thus adjusted relative to the plane of the base body portion 31, this thus adjusting the elevation of the sights on the gun barrel 11.

Referring now to FIG. 8 there is illustrated a modified embodiment of the sight of FIGS. 6 and 7 wherein the sight member is generally designated by reference numeral 22' and is identical to the sight member 22 except for the provision of an aperture 45' in sight portion 43' to thus provide a peep type sight rather than an open sight in the embodiment of FIG. 6. Furthermore, the slot 46 is eliminated from the body portion 42, it being understood that the slot 46 is a discretionary slot which may be eliminated or inserted in either or both of the embodiments. Due to the similarity between parts of the sight member 22' and the sight member 22, and in order to avoid needless repetition of description and illustration, similar reference numerals but having a single prime mark have been applied to the corresponding parts of the sight member of FIG. 8.

There is thus provided a novel slug-ster rear sight intended for detachable mounting on the rear portion of a barrel of a shotgun for providing accurate aiming of the shotgun regardless of choke or length to thus permit its use with a special shotgun shell having a solid slug center which requires accurate aiming thereof, this being accomplished without any need for a special shotgun barrel or the like, and also permitting the shotgun to be used rapidly and interchangeably between such solid slug shell and the conventional shot gun shells having a widespread burst pattern.

It is to be understood that the form of this invention herewith shown and described is to be taken preferred examples of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having just described the invention, what is claimed is:

1. A slug-ster rear sight intended for mounting on a rear end portion of a barrel of a shotgun to be used with a front sight provided on the barrel to provide an accurate and effective aiming device for the aiming of the shotgun barrel regardless of choke or length thereof, the rear sight comprising, in combination:

a base member adapted to frictionally engage the gun barrel to retain the base member detachably mounted thereon;

a sight member mounted on said base member and projecting upwardly therefrom;

sighting means disposed in said sight member and intended for use with said gun barrel front sight in the aligning and aiming of said shotgun;

said base member, and said sighting means being formed integrally of a single flat sheet of material of a general T-shape, said T-shape including a body member of an elongated flat rectangular configuration having a pair of laterally extending wing members formed integrally at one end thereof and projecting laterally outwardly away from the side edges of the body member, said wing members being bent into a semi-circular configuration tangential with the longitudinal axis of the body member to define gripper legs of a diameter adapted to resiliently engage said gun barrel therethrough, said sighting means being formed integrally at the opposite end of said body member and being bent in an upward direction to form a ninety degree angle with said body member to project radially outwardly of said gun barrel when said body member is affixed thereto, and wherein said sighting means is defined by a V-shaped notch formed integrally with a top edge of said sight member and is adapted to be longitudinally aligned with said gun barrel front sight to accomplish the aiming of the gun barrel.

2. A slug-ster rear sight intended for mounting on a rear end portion of a barrel of a shotgun to be used with a front sight provided on the barrel to provide an accurate and effective aiming device for the aiming of the shotgun barrel regardless of choke or length thereof, the rear sight comprising, in combination:

a base member adapted to frictionally engage the gun barrel to retain the base member detachably mounted thereon;

a sight member mounted on said base member and projecting upwardly therefrom;

sighting means disposed in said sight member and intended for use with said gun barrel front sight in the aligning and aiming of said shotgun;

said base member, said sight member, and said sighting means being formed integrally of a single flat sheet of material of a general T-shape, said T-shape including a body member of an elongated flat rectangular configuration having a pair of laterally extending wing members formed integrally at one end thereof and projecting laterally outwardly away from the side edges of the body member, said wing members being bent into a semi-circular configuration tangential with the longitudinal axis of the body member to define gripper legs of a diameter adapted to resiliently engage said gun barrel therethrough, said sighting means being formed integrally at the opposite end of said body member and being bent in an upward direction to form a ninety degree angle with said body member to project radially outwardly of said gun barrel when said body member is affixed thereto, and wherein said sighting means comprises a circular aperture extending through said sight member along the longitudinal axis thereof and spaced inwardly of a top edge thereof, said aperture adapted to be longitudinally aligned with said gun barrel front sight for use in the accurate aiming of said shotgun.

3. A slug-ster rear sight intended for mounting on a rear portion of a barrel of a shotgun to be used with a front sight provided on the barrel to provide an accurate and effective aiming device for the aiming of the shotgun barrel regardless of choke or length thereof, the rear sight comprising, in combination:

a base member adapted to frictionally engage the gun barrel to retain the base member detachably mounted thereon;

a sight member mounted on said base member and projecting upwardly therefrom;

sighting means disposed in said sight member and intended for use with said gun barrel front sight in the aligning and aiming of said shotgun;

an elevation bar member adapted to be disposed intermediate a portion of said base member and a portion of said sight member for adjusting the elevation of said sighting means relative to the plane of said base member; and adjusting means connecting said sight member to said base member.

4. A sight device for a shotgun as set forth in claim 3 wherein said base member comprises, in combination:

an elongated flat rectangularly shaped body portion having a flat top surface, a flat bottom surface, a leading edge, opposed side edges, and a trailing edge;

a pair of laterally extending leg portions formed integrally with said trailing edge and extending laterally outwardly of said opposed side edges, said leg portions being bent downwardly relative to said body portion bottom surface to define a semi-circular configuration adapted to resiliently grip the barrel of the shotgun with the bottom surface of said body portion lying in tangential contact therewith along the longitudinal axis thereof; and an interiorly threaded aperture disposed along the longitudinal axis of said body portion adjacent said trailing edge thereof and spaced inwardly thereof.

5. A sight device for a shotgun as set forth in claim 4 wherein said sight member comprises, in combination:

a flat rectangularly shaped platform portion having a bottom surface, a top surface, opposed ends, and opposed side edges, said bottom surface adapted to lie in parallel juxtaposition with said top surface of said body portion in a position overlying said internally threaded aperture;

an arm member of an elongated flat rectangular configuration connected at one end to said platform portion and projecting upwardly and outwardly therefrom in a position to be vertically spaced above the plane of said platform portion so as to be generally parallel to and spaced vertically from said top surface of said body portion when said sight member is affixed to said base member;

the opposite end of said arm member terminating in an upright sight element disposed at a ninety degree angle to the top surface of said arm member and projecting vertically upwardly therefrom and terminating in a top edge thereof;

sighting means disposed in said upright sight element and intended for use with said sight of said gun barrel when said device is mounted thereon; and a slot disposed in said platform portion and extending laterally intermediate the opposite side edges thereof, said slot being of a width at least equal to the diameter of said threaded aperture in said base body portion and of a length greater than the diameter of said threaded aperture.

6. A sight device for a shotgun as set forth in claim 5 wherein said adjusting means securing said sight member to said base member comprises a screw having a threaded shank adapted to pass through said lateral slot of said platform portion and be threadedly retained in said threaded aperture of said base body portion, said sight member being laterally adjustable relative to the longitudinal axis of said base member by movement of said screw through said slot to thus provide a windage adjustment for said sighting means.

7. A sight device for a shotgun as set forth in claim 6 further characterized by an elevation bar consisting of a wedge shaped member having a flat bottom surface, a vertical upright flat back surface, a leading edge, and a sloped top surface tapering from a maximum height adjacent said back surface to a minimum height adjacent said leading edge disposed opposite said back surface, said top surface being formed by a plurality of contiguous step-like members extending completely thereover; said bottom surface adapted to slide on said base member top surface with said tapered step forming top surface of said elevation bar wedge shaped member adapted to engage the lower surface of said sight member platform portion adjacent its joining with said upright sight element for adjusting the spacing between said sight member and said base member to thus adjust the elevation of the shotgun when the device is utilized thereon.

8. A sight device for a shotgun as set forth in claim 7 wherein said sighting means comprises a V-shaped notch disposed in said upright sight element and extending therethrough and opening out of said top edge thereof and intended for use with said front sight of said gun barrel for use in aiming of the shotgun.

9. A sight device for a shotgun as set forth in claim 7 wherein said sighting means comprises a circular aperture extending through the center vertical axis of said upright sight element spaced inwardly of said top edge of said upright sight element and intended for use with said front sight when said device is mounted on the gun barrel for use in the aiming of said shotgun.

* * * * *